US008823512B2

(12) United States Patent
Spector

(10) Patent No.: US 8,823,512 B2
(45) **Date of Patent: *Sep. 2, 2014**

(54) SENSOR WITH REMOTE COMMUNICATIONS CAPABILITY

(71) Applicant: Donald Spector, New York, NY (US)

(72) Inventor: Donald Spector, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/890,424

(22) Filed: May 9, 2013

(65) Prior Publication Data

US 2013/0241728 A1 Sep. 19, 2013

Related U.S. Application Data

(63) Continuation-in-part of application No. 13/235,592, filed on Sep. 19, 2011, now Pat. No. 8,461,981, which is a continuation-in-part of application No. 13/136,238, filed on Jul. 27, 2011, now Pat. No. 8,542,087, which is a continuation-in-part of application No. 10/949,987, filed on Sep. 24, 2004, now abandoned, which is a continuation-in-part of application No. 09/604,644, filed on Jun. 27, 2000, now Pat. No. 6,812,822, which is a continuation-in-part of application No. 09/065,732, filed on Apr. 24, 1998, now Pat. No. 6,084,527, which is a continuation-in-part of application No. 08/785,815, filed on Jan. 9, 1997, now Pat. No. 5,774,861.

(51) Int. Cl.

| | |
|---|---|
| ***G08B 1/08*** | (2006.01) |
| ***G08B 21/04*** | (2006.01) |
| ***G08B 21/02*** | (2006.01) |

(52) U.S. Cl.
CPC ..... *G08B 21/02* (2013.01); *G08B 21/0492* (2013.01); *G08B 21/0453* (2013.01)
USPC ..... 340/539.12

(58) Field of Classification Search
USPC ..... 340/539.11, 539.22, 5.1, 3.1
See application file for complete search history.

(56) References Cited

U.S. PATENT DOCUMENTS

| | | | | |
|---|---|---|---|---|
| 4,640,034 | A | 2/1987 | Zisholtz | |
| 5,311,875 | A | 5/1994 | Stasz | |
| 5,505,199 | A | 4/1996 | Kim | |
| 6,166,729 | A | 12/2000 | Acosta et al. | |
| 6,192,257 | B1 | 2/2001 | Ray | |
| 6,280,392 | B1 | 8/2001 | Yoshimi et al. | |
| 6,679,830 | B2 | 1/2004 | Kolarovic et al. | |
| 6,720,879 | B2 | 4/2004 | Edwards | |
| 6,968,294 | B2 | 11/2005 | Gutta et al. | |
| 7,009,520 | B2 | 3/2006 | Thompson | |
| 8,461,981 | B1 * | 6/2013 | Spector | 340/539.12 |
| 8,542,087 | B1 * | 9/2013 | Spector | 340/3.1 |
| 2004/0082840 | A1 | 4/2004 | Chen | |
| 2005/0080322 | A1 | 4/2005 | Korman | |
| 2007/0004969 | A1 | 1/2007 | Kong et al. | |
| 2009/0106045 | A1 | 4/2009 | Bae et al. | |
| 2010/0190480 | A1 | 7/2010 | Zheng et al. | |

* cited by examiner

*Primary Examiner* — Vernal Brown
(74) *Attorney, Agent, or Firm* — Collard & Roe, P.C.

(57) ABSTRACT

A system and method for monitoring the state of an individual, in which a biological sensor is attached to the individual, and a wireless transmitter is attached to the sensor via a microprocessor. The transmitter transmits any changes in the biological state of the individual to a remote receiver. The remote receiver can be programmed to automatically send an alert to various entities, which can then send assistance.

9 Claims, 2 Drawing Sheets

SENSOR WITH REMOTE COMMUNICATIONS CAPABILITY

CROSS REFERENCE TO RELATED APPLICATIONS

This is a continuation-in-part of U.S. patent application Ser. No. 13/235,592, filed on Sep. 19, 2011, which is a continuation-in-part of U.S. patent application Ser. No. 13/136,238 filed on Jul. 27, 2011, which is a continuation-in-part of U.S. patent application Ser. No. 10/949,987 filed on Sep. 24, 2004, which is a continuation-in-part of U.S. patent application Ser. No. 09/604,644 filed on Jun. 27, 2000, now U.S. Pat. No. 6,812,822 issued Nov. 2, 2004, which is a continuation-in-part of U.S. patent application Ser. No. 09/065,732 filed on Apr. 24, 1998, now U.S. Pat. No. 6,084,527 issued Jul. 4, 2000, which is a continuation-in-part of U.S. patent application Ser. No. 08/785,815 filed on Jan. 9, 1997, now U.S. Pat. No. 5,774,861 issued Jun. 30, 1998 entitled "Mirror and Light Box Assembly with Mother's Image Display and Voice Playback Activated by Crying Infant". The disclosures of all of these applications and patents are herein incorporated by reference.

BACKGROUND OF THE INVENTION

1. Field of the Invention

This invention relates to a system for monitoring the health and viability of individuals while performing a certain task. In particular, the invention relates to a sensor attached to an individual that alerts another entity if the individual's vital signs deviate from a preset threshold, so that treatment or other measures can be taken.

2. The Prior Art

Health sensors are known, in which health care professionals are alerted when a patient is in distress. These often are in the confines of a hospital and involve cumbersome equipment.

Wireless sensors are also known, in which the state of the patent is transmitted wirelessly to a remote receiver. An example of this is US Patent Application Publication No. 2007/0004969 to Kong et al.

While there are several patents and patent applications related to sensing the health of patients, this technology has not been adapted to athletic or workplace scenarios. It would be desirable to incorporate a biological sensor into a workplace or athletic complex to alert employers or coaches when the individual's vital signs deviate from a preset threshold, such as if an employee falls asleep on the job, or if an athlete's heart rate or blood pressure exceeds a desired range.

SUMMARY OF THE INVENTION

In view of the foregoing, it is an object of this invention to provide a system that monitors the state of at least individual and transmits any changes in the biological state of the individual to a remote receiver, which can automatically alert a third party to the changes.

This object is accomplished by a system and method for monitoring the state of an individual, in which a biological sensor is attached to the individual, and a wireless transmitter is attached to the sensor. The transmitter transmits any changes in the biological state of the individual to a remote receiver. The remote receiver can be programmed to automatically send an alert to various entities, which can then contact the individual with instructions.

The sensor can be a heart rate sensor, a respiration sensor, a temperature sensor, a noise sensor, a brain wave sensor, or any other type of sensor, based on the requirements of the user. Typically, the sensor will be a heart rate sensor. An increased heart rate can signal distress, and a slower heartbeat can signal sleep. Depending on the condition to be monitored, the sensor can be equipped with an alarm to monitor sleep of employees on the job, cardiac distress of athletes, or other biological conditions of individuals, such as those with health problems.

A camera can be connected to the sensor, to show the surrounding area when the sensor indicates distress or death. This can be helpful to further identify the biological condition of the individual. The camera can show if the employee is sleeping, or the athlete or patient is in distress. The camera can be automatically activated when the sensor senses a change in the biological condition outside of a predetermined threshold.

The receiver is preferably a mobile telephone. The mobile telephone can be programmed to automatically call the third party with a prerecorded distress message, either that the individual is in distress and requests assistance, or that the employee is sleeping. The mobile telephone can have a computer and a display so that the physical parameters that are sensed can be displayed on the display. The display can be activated only when the sensor senses a change in one of the parameters, or can be a continuous display.

The sensor can be attached to the individual in any suitable manner, such as by adhesive, or strapped on as in a wrist watch or arm band or head band.

The system can also include a GPS (Global Positioning System) receiver connected to the transmitter. The transmitter transmits the location of the GPS receiver along with the data sensed by the sensor to the receiver when the sensor senses a change in the physical parameter.

The transmitter can be programmed via a microprocessor to only transmit when the change in physical parameters is sufficient enough to cause concern. For example, a change in heart rate that exceeds 20% of a resting heart rate, a drop or increase in body temperature of more than 3 degrees F., a significant change in brain wave activity, etc.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

DETAILED DESCRIPTION OF THE PREFERRED EMBODIMENT

Figure 1:
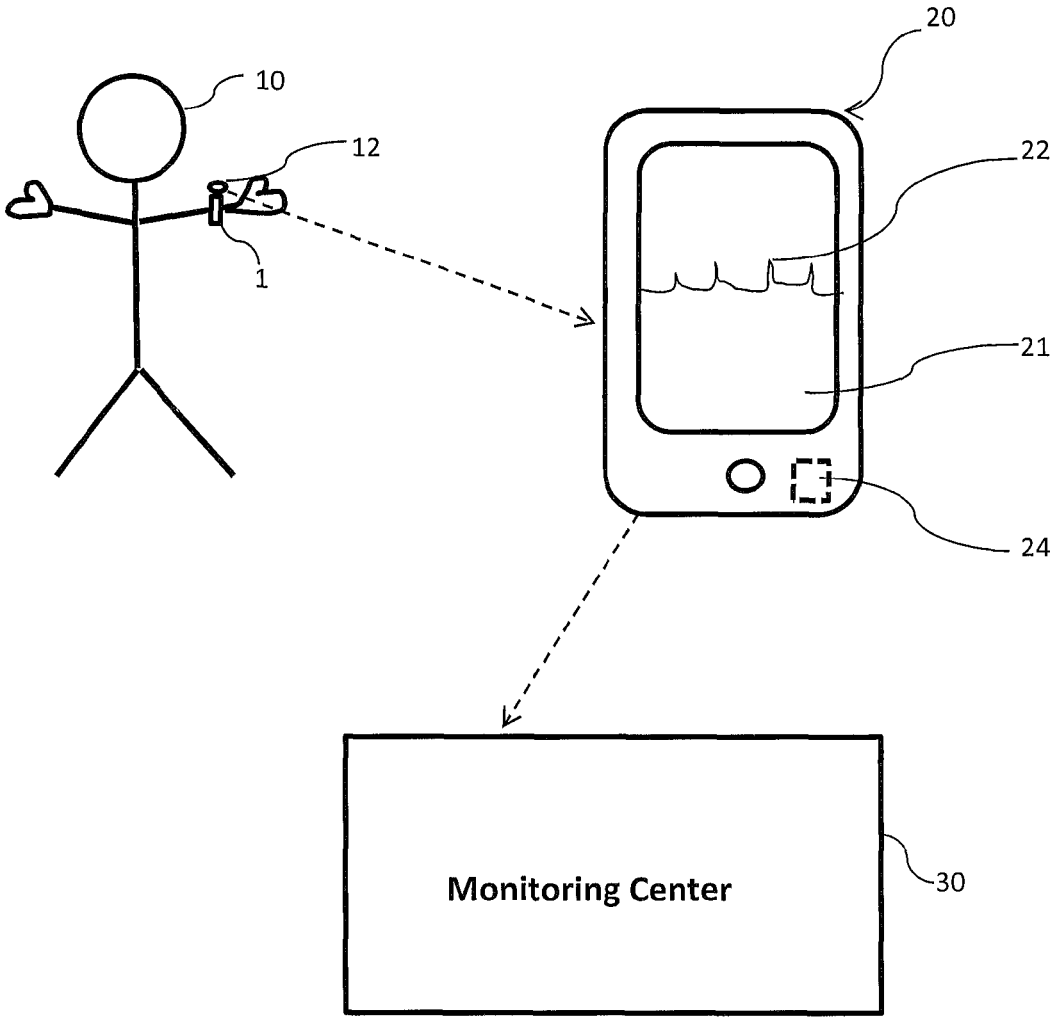
FIG. 1 shows a block diagram of the system according to the invention.
Figure 2:
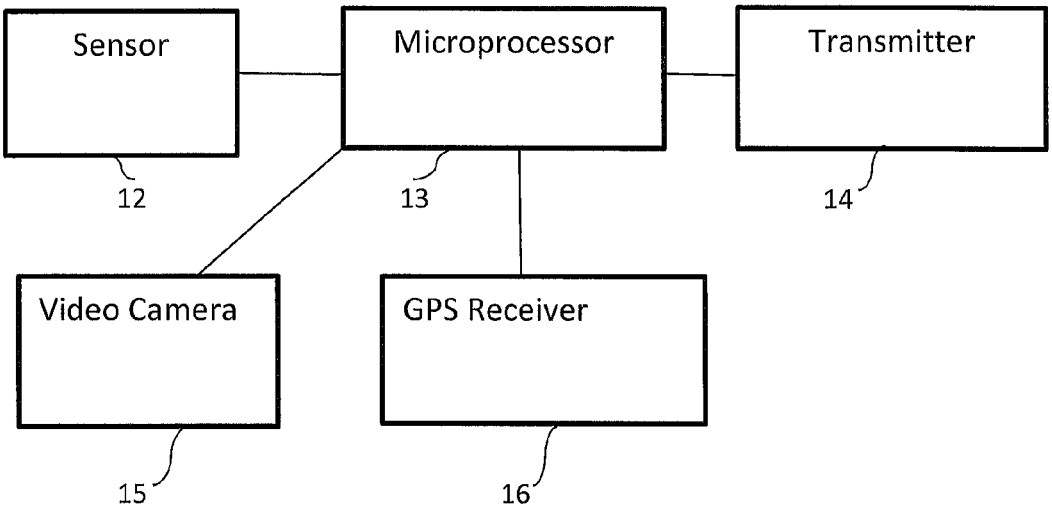
FIG. 2 shows a block diagram of the sensor, transmitter and video camera according to the invention.

As shown in FIG. 1, the system according to the invention comprises a module 1, which is worn by an individual 10, via an attachment device, such as a wrist band 11. As shown in FIG. 2, module 1 consists of a sensor 12, which is adapted to sense a physical parameter of the individual on which the sensor is placed, and a microprocessor 13, which processes the data sensed by the sensor. Connected to microprocessor 13 is a transmitter 14, which, as controlled by microprocessor 13, transmits data sensed by sensor 13 to a remote location, namely receiver 20. Receiver 20 is a mobile telephone, which is equipped with an internal, internet-capable computer 24 and a display 21. Receiver 20 receives data transmitted from transmitter 14 over the internet or a cellular network, which is then displayed in the form of graphical data 22 on display 21. Receiver 20 can be automatically programmed via computer 24 to call a monitoring center 30 with a warning signal or message when receiver 20 receives data from transmitter 14 that indicates a significant change in the physical parameters, thus indicating sleep, cardiac distress or other trauma, which will then alert the command center to contact the individual and/or send assistance.

Also connected to microprocessor 13 is a video camera 15, which is controlled by microprocessor 13 to begin recording the surrounding area when sensor 12 senses a change in the measured physical parameters. This can provide additional information to the command center in the event of an emergency. Video data from video camera 15 is sent via transmitter 14 to receiver 20 where it also can be viewed on display 21.

A GPS receiver is also be connected to microprocessor 13. When sensor 12 senses a change in the physical parameters of guard 10, transmitter 14 transmits the location of guard 10 to receiver 20, along with the sensor data and video data. All of this can be passed on to monitoring center 30 via cellular signals or data transmission over the internet. Computer 24 in receiver 20 can vary the transmission of signals to monitoring center 30 based on the level of threat detected by sensor 12. For example, if sensor 12 detects an elevated heartbeat of the individual 10, then computer 24 might categorize this as a mild disturbance and this information can then be sent to monitoring center 30. However, if sensor 12 detects a lack of heartbeat or erratic heartbeat, then computer 24 can categorize this as an urgent warning to be sent to monitoring center 30. The warnings can take the form of recorded voice instructions, alarm bells, text messages, flashing lights or any other type of warning.

The system according to the invention can provide instantaneous data regarding the state of an individual to a remote monitoring center, which can then act to send in assistance as soon as a life or health-threatening situation occurs. The system can also be used by employers to monitor employees sleeping on the job, or using substances that affect their vital signs. The system alerts the monitoring center of the situation even when the individual is disabled or dead, because the change in the physical parameters measured by the sensor triggers the communication system and does not require action by the individual. The microprocessor 13 can be programmed to trigger the transmitter 14 when the change in parameters exceeds certain thresholds, such as 20% above or below a normal resting heartbeat, a drop or increase in body temperature of more than 3 degrees, a change in brain waves, etc.

Accordingly, while only a few embodiments of the present invention have been shown and described, it is obvious that many changes and modifications may be made thereunto without departing from the spirit and scope of the invention.

What is claimed is:

1. A system for monitoring the physical state of an individual, comprising:

a sensor adapted to monitor a physical parameter of the human or animal, a microprocessor connected to the sensor to process data received from the sensor;

a first transmitter connected to the microprocessor for transmitting data sensed by the sensor to a remote location, the microprocessor being programmed to have the first transmitter transmit when the sensor senses a change in the physical parameter;

a receiver adapted to receive transmissions from the first transmitter, the receiver being connected to a second transmitter for transmitting data received from the first transmitter to a command center, wherein the receiver contains a computer that determines an alert level based on the transmissions from the first transmitter, and wherein the second transmitter transmits said alert level to the monitoring center.

2. The system according to claim 1, wherein the receiver is a mobile telephone.

3. The system according to claim 1, wherein the sensor monitors a physical parameter selected from the group consisting of heart rate, respiration, brain activity, blood pressure and body temperature.

4. The system according to claim 1, wherein the sensor is a noise sensor and wherein the microprocessor is programmed allow the transmitter to transmit only upon the sensor sensing a particular noise.

5. The system according to claim 1, further comprising a video camera connected to the microprocessor, wherein the microprocessor is programmed to start the video camera recording when the sensor senses a change in the physical parameter.

6. The system according to claim 1, wherein the sensor is attached to a wrist band.

7. The system according to claim 2, wherein the mobile telephone includes a display, and wherein the display displays the parameter sensed by the sensor.

8. The system according to claim 1, wherein the first transmitter transmits data over the internet to the receiver.

9. The system according to claim 1, wherein the microprocessor is connected to a GPS receiver, and wherein the transmitter transmits a location of the GPS receiver to the receiver.

* * * * *